US007841923B2

(12) United States Patent
Marzetta et al.

(10) Patent No.: US 7,841,923 B2
(45) Date of Patent: Nov. 30, 2010

(54) VEHICLE AXLE JOINT FOR A TOY VEHICLE

(75) Inventors: Michael Marzetta, Veradale, WA (US); Levi R. Wilson, Spokane Valley, WA (US); Kriston M. Broxson, Spokane, WA (US)

(73) Assignee: Minds-I, Inc., Liberty Lake, WA (US)

( * ) Notice: Subject to any disclaimer, the term of this patent is extended or adjusted under 35 U.S.C. 154(b) by 506 days.

(21) Appl. No.: 11/983,860

(22) Filed: Nov. 13, 2007

(65) Prior Publication Data

US 2009/0124166 A1 May 14, 2009

(51) Int. Cl.
*A63H 17/26* (2006.01)

(52) U.S. Cl. ..... 446/466; 446/103; 446/289; 446/469; 180/349; 180/358; 180/376

(58) Field of Classification Search ..... 180/264, 180/347, 343, 383, 337, 344, 348, 349, 358; 248/288.31, 349.1; 446/103, 466, 469
See application file for complete search history.

(56) References Cited

U.S. PATENT DOCUMENTS

| | | | | |
|---|---|---|---|---|
| 1,144,284 | A | 6/1915 | Bassett | |
| 1,248,068 | A | 11/1917 | Brunel | |
| 1,438,313 | A * | 12/1922 | Kollman | 180/267 |
| 1,450,471 | A | 4/1923 | Wickersham | |
| 2,198,353 | A * | 4/1940 | Tjaarda | 180/376 |
| 2,207,882 | A * | 7/1940 | Wasserman | 475/222 |
| 2,695,095 | A | 11/1954 | Anderson | |
| 2,868,271 | A * | 1/1959 | Pickles | 248/419 |
| 2,885,822 | A | 5/1959 | Onanian | |
| 2,898,798 | A | 8/1959 | Carno | |
| 3,053,579 | A | 9/1962 | Trudeau | |
| 3,112,547 | A | 12/1963 | Poe | |
| 3,192,738 | A | 7/1965 | Charles et al. | |
| 3,205,611 | A | 9/1965 | Onanian | |
| 3,231,316 | A | 1/1966 | Ruf | |
| 3,378,219 | A | 4/1968 | Biesecker | |
| 3,406,431 | A | 10/1968 | Armstrong et al. | |
| 3,469,339 | A | 9/1969 | Thomas | |
| 3,568,263 | A | 3/1971 | Meehan | |
| 3,611,609 | A | 10/1971 | Reijnhard | |
| 3,628,834 | A | 12/1971 | Anderson | |
| 3,657,838 | A | 4/1972 | Hanning et al. | |
| 3,697,104 | A | 10/1972 | Soulie et al. | |

(Continued)

FOREIGN PATENT DOCUMENTS

WO WO 2006/045068 4/2006

OTHER PUBLICATIONS

U.S. Appl. No. 11/290,333, filed Nov. 29, 2005, Marzetta.

(Continued)

*Primary Examiner*—Gene Kim
*Assistant Examiner*—Matthew B Stanczak
(74) *Attorney, Agent, or Firm*—Well St. John PS

(57) ABSTRACT

A vehicle axle joint for a toy vehicle is described and which includes a socket portion; and a ball portion which matingly cooperates with the socket portion, and which defines a gear cavity, and wherein the ball portion may be selectively oriented relative to the socket portions so as to allow hobbyists to construct a multitude of toy vehicles.

1 Claim, 8 Drawing Sheets

U.S. PATENT DOCUMENTS 3,744,101 A 7/1973 Gley
3,755,959 A 9/1973 Boberg
3,811,219 A 5/1974 Fischer
3,857,617 A 12/1974 Grawley
3,918,130 A 11/1975 Poe
3,975,858 A 8/1976 Much
4,057,886 A 11/1977 Brass
4,105,259 A 8/1978 Boucher
4,114,509 A 9/1978 Poe
4,137,115 A 1/1979 Lambert
4,141,599 A 2/1979 Stolz
4,289,213 A 9/1981 Seaman
4,390,214 A 6/1983 Gunter et al.
4,405,272 A 9/1983 Wollar
4,448,273 A 5/1984 Barbieri
4,531,870 A 7/1985 Moryl et al.
4,551,110 A 11/1985 Selvage et al.
4,674,930 A 6/1987 Poe et al.
4,688,447 A 8/1987 Dick
4,690,656 A * 9/1987 Friedman et al. ..... 446/95
4,694,556 A 9/1987 Hewitt
4,729,606 A 3/1988 Narita et al.
4,805,365 A 2/1989 Bastian
4,823,532 A 4/1989 Westerburgen
4,823,632 A 4/1989 Harrod et al.
4,882,901 A 11/1989 Lapeyre
4,992,069 A 2/1991 Bolli et al.
5,009,599 A 4/1991 Mueller
5,049,104 A 9/1991 Olsen
5,215,185 A 6/1993 Counter et al.
5,303,818 A 4/1994 Gruettner et al.
5,322,466 A 6/1994 Bolli et al.
5,409,306 A 4/1995 Bentz
5,634,863 A 6/1997 Brissenden et al.
5,704,868 A 1/1998 Lindsey et al.
5,726,023 A 3/1998 Cheever et al.
5,839,938 A 11/1998 Manthei et al.
5,928,051 A 7/1999 Krog
5,931,255 A 8/1999 Sewell
5,938,497 A 8/1999 Mott
5,964,635 A 10/1999 Krog
6,102,766 A 8/2000 Leadbetter et al.
6,301,747 B1 10/2001 Parein
6,461,215 B1 10/2002 Kunz et al.
6,540,461 B1 4/2003 Hawang
6,595,825 B1 7/2003 De Wilde
6,682,385 B2 1/2004 Atzen et al.
6,732,856 B2 5/2004 Maine, Jr.
6,736,691 B1 5/2004 Bach
6,942,540 B2 9/2005 Lee
7,314,132 B2 1/2008 Layne et al.
2005/0236540 A1 * 10/2005 Bennett ..... 248/226.11

OTHER PUBLICATIONS

U.S. Appl. No. 11/443,556, filed May 30, 2006, Marzetta.
U.S. Appl. No. 11/526,264, filed Sep. 22, 2006, Marzetta.
U.S. Appl. No. 11/724,422, filed Mar. 14, 2007, Marzetta et al.
U.S. Appl. No. 11/827,547, filed Jul. 11, 2007, Marzetta et al.

* cited by examiner

VEHICLE AXLE JOINT FOR A TOY VEHICLE

TECHNICAL FIELD

The present invention relates to a vehicle axle joint for a toy vehicle, and more specifically, a vehicle axle joint which may be readily angularly oriented in relation to a motor of the toy vehicle, and which further finds particular usefulness in a toy construction system which is employed by hobbyists.

BACKGROUND OF THE INVENTION

Power in the form of force has been transferred from one location to another for thousands of years. From the first grist mills, the transfer of power between locations was made by using gears, and these gears remained stationary in relation to the power source, such as a paddle wheel, for example. However, the transfer of power between locations where one of the locations is not fixed, or may need to be relocated, presents challenges for those in the mechanical arts.

In the area of hobby crafts, such as in the assembly of remotely controlled model vehicles, and robots, the problems associated with the transfer of power from an engine to another location has been problematic. For example, many hobbyists enjoy building toys and model vehicles that are remotely controlled, and which are both realistic and easily modified. As part of this modification, for example, the hobbyist may interchange parts such as wheels so as to convert a toy vehicle such as a road racer to an off-road type vehicle. Such modifications of the toy vehicle requires the hobbyist to realign certain power transmission regions of the toy vehicle during the modification of the vehicle.

The inventors have variously disclosed in copending patent application Ser. Nos. 11/290,333; 11/443,556; 11/526,264; 11/724,422; and 11/827,547, a construction system, and components useful with a construction system. The teachings of these copending applications are incorporated by reference herein. This disclosed construction system, and its variations, provides a means by which a hobbyist can build robust articles of interest, such as toy vehicles and the like, in a manner not possible heretofore.

While the construction system, as disclosed in these pending applications, have worked with a great deal of success, an acute need has emerged to provide an assembly which will allow a hobbyist to rapidly modify toy vehicles in a manner whereby the relative angular positions of the motor and an axle may be easily changed. This will permit the hobbyist to construct an almost unlimited number of vehicular model arrangements, and thereby increase the versatility and usefulness of the aforementioned construction systems.

A vehicle axle joint for a toy vehicle which is useful in a construction system as disclosed in these earlier copending applications is the subject matter of the present invention.

SUMMARY OF THE INVENTION

A first aspect of the present invention relates to a vehicle axle joint for a toy vehicle which includes a socket portion; and a ball portion matingly cooperating with the socket portion, and defining a gear cavity, and wherein the ball portion defines at least two openings which are individually configured to receive at least one drive shaft, and another shaft configured to receive power from the drive shaft.

Another aspect of the present invention relates to a vehicle axle joint for a toy vehicle and which is configured to provide rotational force from at least one rotating drive shaft to an axle of a toy vehicle, the vehicle including an outer portion which defines an internal cavity, and wherein the outer portion has a connector unit which matingly cooperates with at least one connector unit of a construction system; and an inner portion received within the cavity defined by the outer portion, and wherein the outer portion engages the inner portion so as to selectively orient the inner portion relative to the outer portion.

Still another aspect of the present invention relates to a vehicle axle joint for a toy vehicle and which includes a vehicle frame which has a length dimension as measured along a longitudinal axis, and a width dimension as measured along a transverse axis; a motor mounted on the vehicle frame; a drive shaft having a first end which is mechanically coupled to the motor, and a second end, and wherein the drive shaft is oriented substantially along the longitudinal axis of the vehicle frame; a gear assembly mechanically coupled to the second end of the drive shaft; an axle borne by the vehicle frame, and which is mechanically coupled to the gear assembly, and wherein the axle is located substantially parallel to the transverse axis of the vehicle frame; an adjustable ball portion defining a gear cavity that encloses the gear assembly; and a socket portion defining a housing which is releasably mounted on the vehicle frame, and which defines a cavity for receiving the adjustable ball portion, and wherein the adjustable ball portion can be selectively positioned within the cavity of the housing so as to orient the drive shaft in a range of angular relationships relating to the longitudinal axis of the toy vehicle.

Yet still another aspect of the present invention relates to a vehicle axle joint for a toy vehicle which includes a first portion which is substantially rigidly mounted on a frame of a toy vehicle; and a second portion moveably received within the first portion, and which has an X, Y, and Z axis, and which further defines an aperture for receiving an axle borne by the frame of the toy vehicle along the Y axis, and an aperture for receiving a drive shaft of the toy vehicle along the X axis, and wherein the second portion is selectively positionable within the first portion so as to position the aperture for receiving the drive shaft along an arcuately shaped path which is oriented along the Z axis.

These and other aspects of the present invention will be discussed in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
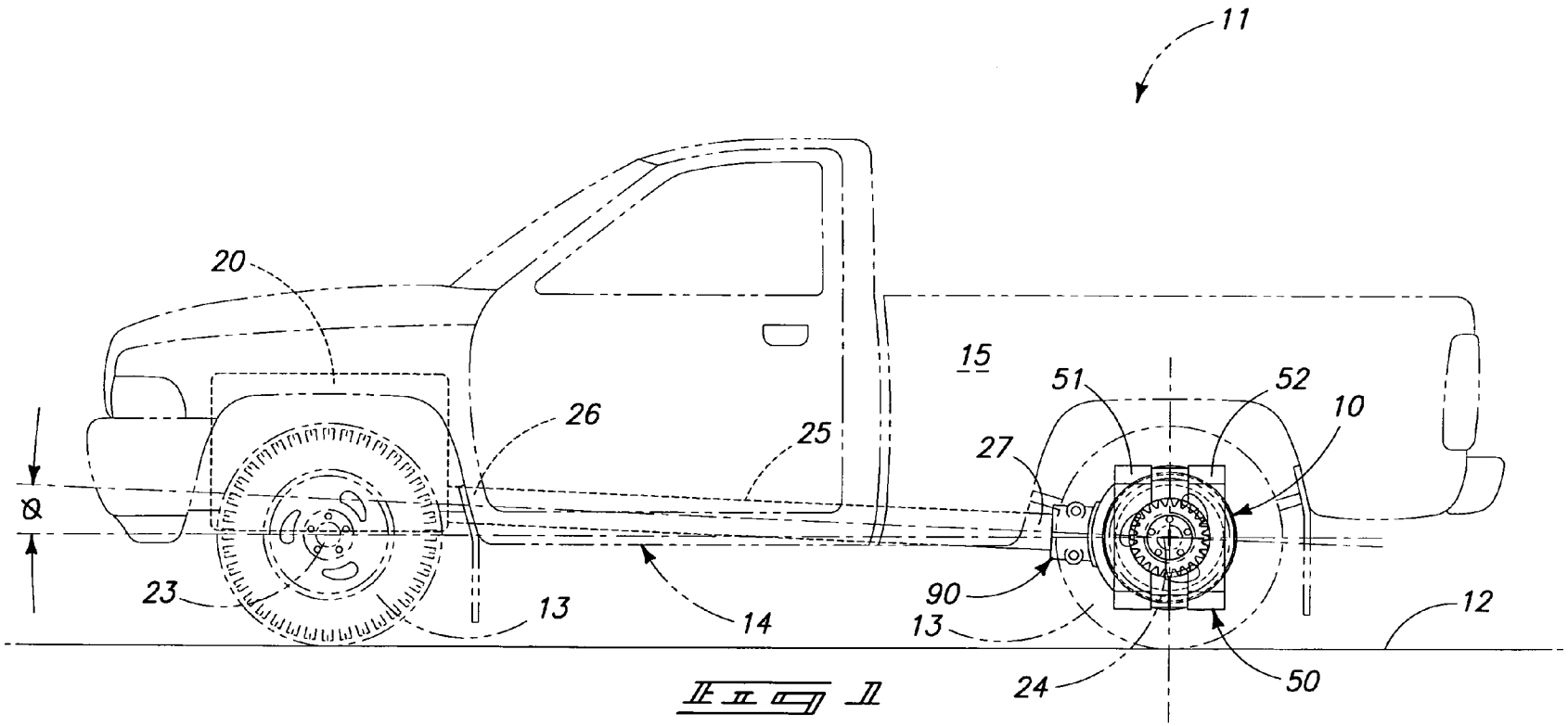
FIG. 1 is a side elevation view of the vehicle axle joint employed on a first toy vehicle.
Figure 2:
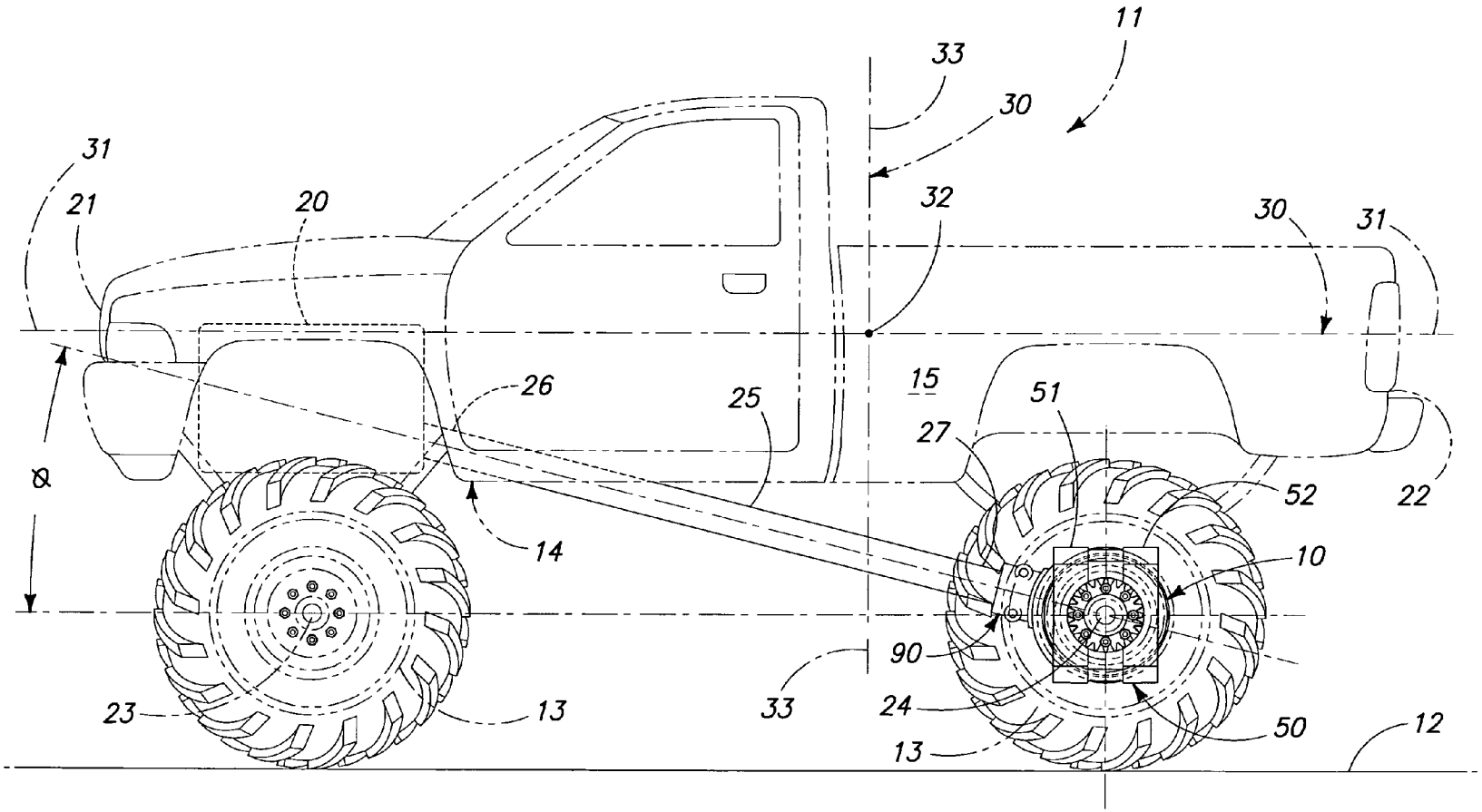
FIG. 2 is a second, side elevation view of the same vehicle axle joint employed on a second toy vehicle.

A vehicle axle joint for a toy vehicle is generally indicated by the numeral 10 in FIG. 1 and following. As seen in the various drawings, the vehicle axle joint 10 is useful when utilized in connection with a toy vehicle which is generally indicated by the numeral 11 as seen in FIGS. 1 and 2, respectively. As seen therein, the toy vehicles take on the appearance of their larger counterparts, and are useful when remotely controlled by means of a radio controller, not shown, for movement across the surface of the earth 12. Each of the toy vehicles 11 has a plurality of earth engaging wheels generally indicated by the numeral 13. The earth engaging wheels are variously supported on the vehicle frame 14, and are useful for positioning the vehicle frame 14 in variously spaced relationships relative to the surface of the earth 12. The vehicle frame 14, in turn, supports a vehicle chassis 15 which may take on various shapes such as the two truck shapes as seen. However, the vehicle chassis can assume various other designs such as a racing car, classic muscle car, military vehicle, emergency vehicle or any other vehicle of interest to the hobbyist, including various robotic assemblies. Affixed on the vehicle frame 14 is a motor of conventional design, and which is remotely controlled by a hobbyist (not shown). The vehicle frame 14 has a first end 21. The motor 20 is typically located adjacent the first end of the vehicle frame. However, depending upon the type of toy vehicle being constructed, this motor may be located intermediate the first and second ends 21 and 22, or may be located adjacent to the second end 22 depending upon the design of the toy vehicle being constructed by the hobbyist. The toy vehicle 11 has a front axle 23 which rotatably supports a pair of earth engaging wheels 13, and a rear axle which is generally indicated by the numeral 24 and which also supports a pair of earth engaging wheels. While the front and rear axles are shown with two supporting wheels, the hobbyist may elect to have an axle with only one supporting wheel, or may have more than two supporting wheels on each axle. Additionally, it will be understood that the rear axle may be attached to the frame by means of an intermediate assembly such as a shock absorber, leaf spring or other similar assembly (not shown). Still further, in some arrangements, a track may engage the supporting surface 12 rather than a wheel. In the arrangement as seen in FIGS. 1 and 2, a drive shaft 25 having a first end 26, which is mechanically coupled to the motor 20, is operable to impart rotatable driving force to the rear axle 24. The drive shaft has a second end 27 which is drivingly received within and which mechanically cooperates with the vehicle axle joint 10 as will be described in greater detail hereinafter.

Figure 3:
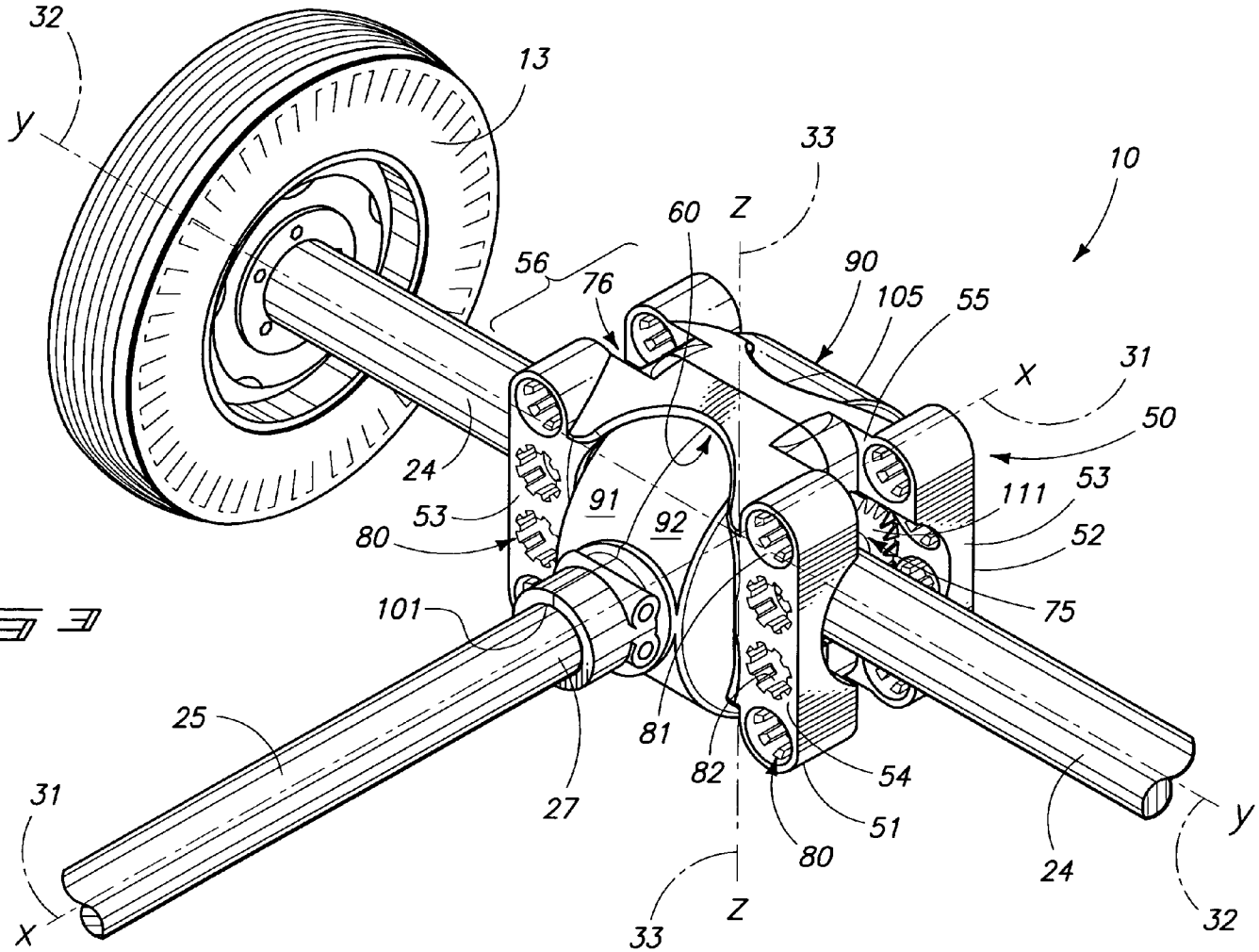
FIG. 3 is a fragmentary, perspective, side elevation view of a vehicle axle joint of the present invention.

Referring now to FIGS. 2 and 3, it should be understood that the vehicle axle joint 10 is positioned along and is angularly oriented relative to various axes relative to the toy vehicle 11, generally. As should be understood, these plurality of axes 30 include a first longitudinal or X axis 31 which generally extends between the first and second ends 21 and 22 of the vehicle frame; a second, transverse or Y axis which is generally indicated by the numeral 32, and which is transverse to the longitudinal X axis, and is substantially parallel to the orientation of the front and rear axles 23 and 24, respectively; and a Z axis 33 which is substantially perpendicular relative to the first and second X and Y axes 31 and 32, respectively. As will become evident hereinafter, the vehicle axle joint 10 allows the drive shaft 25 to be selectively positioned along the Z axis thereby allowing a hobbyist to orient the drive shaft 25 in a range of angular relationships relative to the longitudinal X axis 31 of the toy vehicle 11. This is seen by a study of FIGS. 1 and 2. This feature allows a hobbyist to redesign their toy vehicle utilizing earth engaging wheels 13 of various diameters. This feature of the invention also permits toy vehicles 11 of various designs to be designed, retrofitted and then changed over time in various manners as will become more evident hereinafter.

Figure 7:
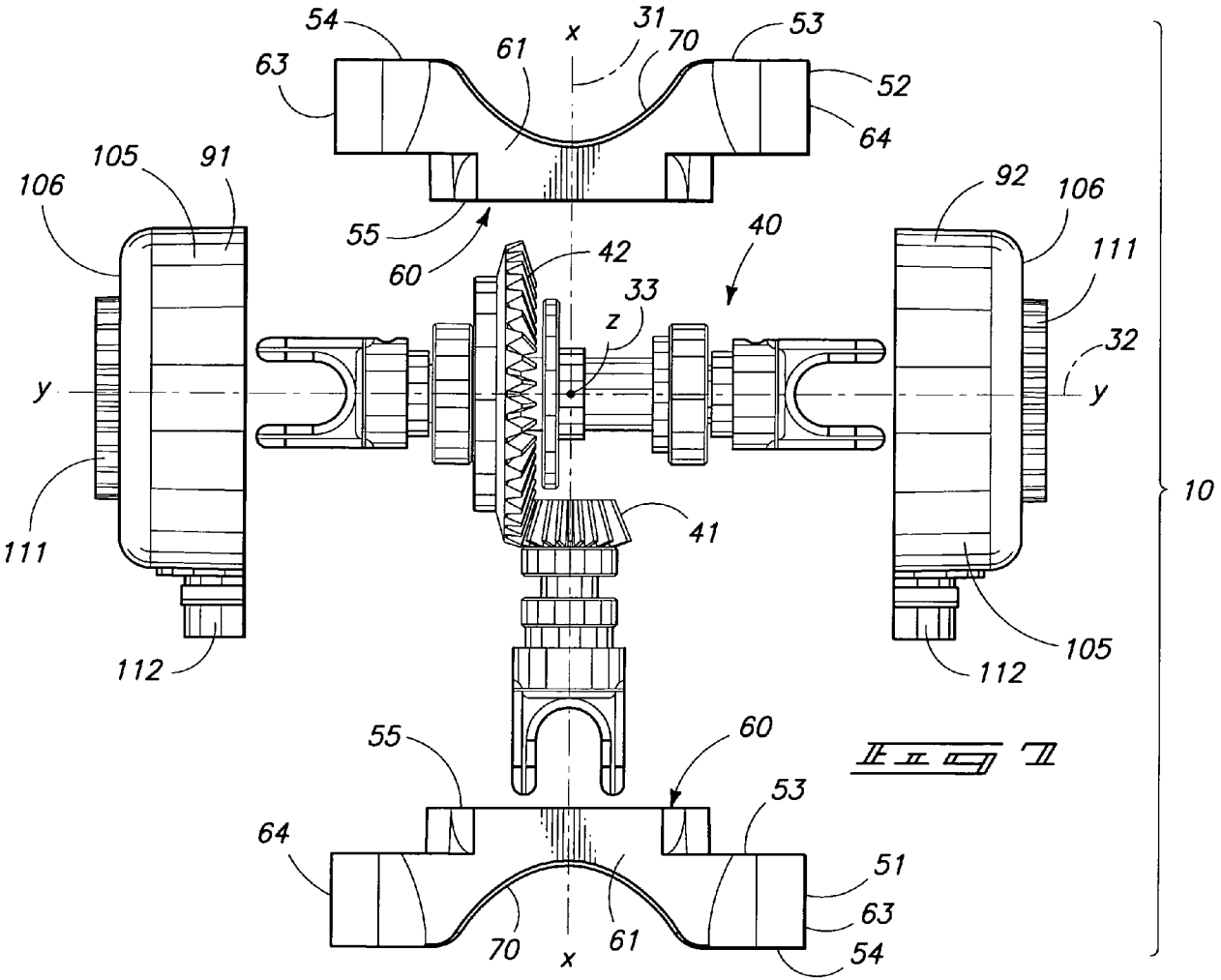
FIG. 7 is an exploded, top plan view of a vehicle axle joint for a toy vehicle of the present invention.

Referring now to FIG. 7, the second end 27 of the drive shaft 25 is drivingly coupled to a gear assembly which is generally indicated by the numeral 40, and which is well known in the art. The gear assembly includes at least two beveled gears 41 and 42, respectively which meshingly engage each other and which transmits force from the motor 20 to the rear axle 24. The first beveled gear 41 is mounted distally on the second end 27 of the drive shaft 25, and the second beveled gear 42 meshingly engages the first bevel gear and is operable to transmit the force from the drive shaft to the rear axle 24. The gear assembly 40 is rigidly affixed or otherwise supported in a given location on the vehicle frame 14 by means of a first socket portion which will be described in detail in the paragraphs which follow.

The vehicle axle joint 10 of the present invention includes a first socket portion which is generally indicated by the numeral 50, and which is further rigidly affixed to the vehicle frame 14 by means of a fastener body and a locking member similar to those described in U.S. patent application Ser. Nos. 11/290,333 which was filed on Nov. 29, 2005; and 11/443,556, which was filed on May 30, 2006, the teachings of which are incorporated by reference herein. The first socket portion 50 is comprised of first and second members 51 and 52 which are substantial mirror images of each other. The first and second members each have a main body 53 which is defined by an outside facing surface 54, and an opposite inside facing surface 55. The first and second members matingly cooperate so as to define a housing 55 which is releasably mounted on the vehicle frame 14. When assembled in an appropriate mating relationship, the first and second members 51 and 52 define a cavity 60 therein for receiving an adjustable ball portion which will be discussed in greater detail hereinafter. In the arrangement as seen in the drawings, this adjustable ball portion can be selectively positioned within the cavity 60 of the housing 55 so as to accommodate a range of angular relationships as measured between the drive shaft 25 and the longitudinal or X axis 31 of the toy vehicle 11 as earlier disclosed.

Figure 4:
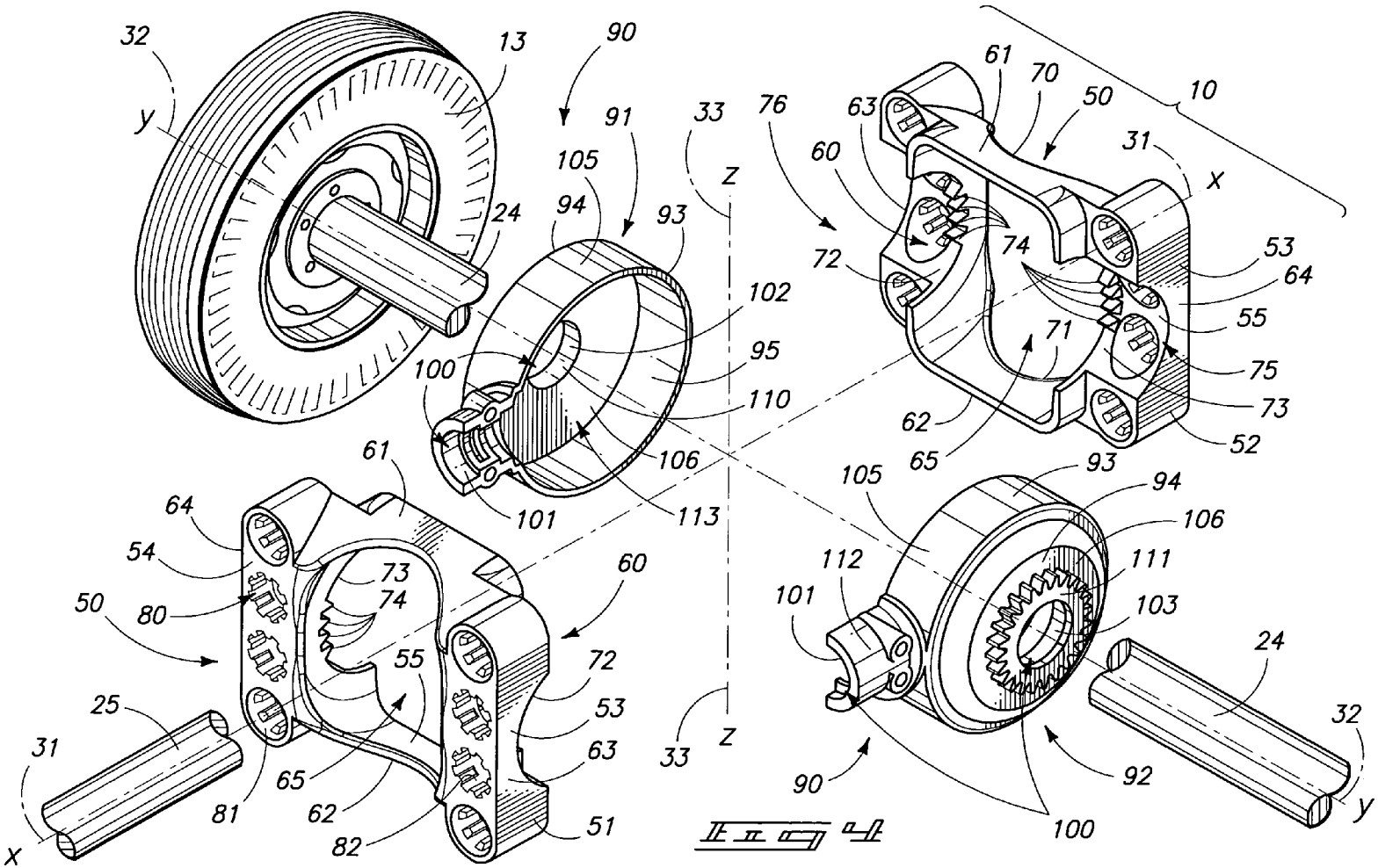
FIG. 4 is a fragmentary, exploded, perspective, side elevation view of a vehicle axle joint for a toy vehicle of the present invention.

The main body 53 of the first socket portion 50 is defined by first, second, third and fourth sidewalls which are generally indicated by the numerals 61, 62, 63 and 64, respectively. As best seen by reference to FIG. 4, it will be recognized that the first and second sidewalls are disposed in predetermined spaced, opposing orientations relative to the main body 53. Further, the third and fourth sidewalls 63 and 64 are similarly positioned in predetermined, spaced, opposing orientations one relative to the other. In the form of the invention, as illustrated, it will be recognized that the third and fourth sidewalls 63 and 64 are disposed in substantially parallel, spaced relation one relative to the other. However, it will be understood that in other possible forms of the invention, these third and fourth sidewalls 63 and 64 may be disposed in non-parallel orientations one relative to the other. The structure of the third and fourth sidewalls will be discussed in greater detail below. As seen in FIG. 4, for example, it will be understood that the first, second, third and fourth sidewalls 61, 62, 63 and 64 define a passageway 65 which extends therethrough between the outside facing surface 54, and the opposite inside facing surface 55. This passageway will accommodate or permit, at least in part, a portion of a second, ball portion, which will be discussed in greater detail below, to extend therethrough. In the arrangement as seen in the drawings, the first and second sidewalls 61 and 62 each define an arcuately shaped leading edge which is generally indicated by the numeral 71 and 72, respectively. Still further, the third and fourth sidewalls 63 and 64 each define a concavely shaped portion 72 and 73, respectively. Additionally, as will be seen in FIG. 4, a plurality of teeth are formed therealong the concavely shaped portion 72 and 73 and are operable to matingly engage or meshingly cooperate with a portion of the second ball portion as will be discussed in greater detail hereinafter. When the first and second members 51 and 52 are matingly brought together, the concavely shaped portions 72 and 73 of the respective first and second members 51 and 52 define first and second substantially coaxial aligned apertures or openings 75 and 76 which are concentrically oriented relative to the ball portion as will be discussed below. These apertures or openings accommodate or permit the passage of the rear axle 24 therethrough so that the rear axle can mechanically cooperate with the gear assembly 40 in a manner which is well understood in the art.

Still referring to FIGS. 3 and 4, it will be understood that a plurality of passageways which are generally indicated by the numeral 80 are formed in the third and fourth sidewalls 63 and 64. These plurality of passageways which pass therethrough are defined by interior sidewalls 81. The interior sidewalls define a plurality of orientation grooves 82 which are operable to matingly couple with the fastener assemblies as more completely disclosed in U.S. patent application Ser. No. 11/290,333, the contents of which are incorporated by reference herein. As seen in the drawings, the plurality of passageways 80 are substantially coaxially aligned with the adjacent mirror image portion when the first socket portion 50 is appropriately assembled as seen in FIG. 3. The plurality of passageways 80 can be appropriately oriented in substantially coaxial relation relative to other construction members (Not shown) such as seen in the above identified copending application in order to rigidly affix the first socket portion 50 to the vehicle frame 14 of the toy vehicle 11. Still further, other assemblies can matingly engage the plurality of passageways 80. Such additional assemblies may include suspension systems, shock absorbers, and other assemblies which are well known in the art. In the arrangement as seen in the present drawings, the plurality of passageways 80 will be referred to hereinafter as female connector units that matingly and releasably cooperate with a plurality of connector units of the toy construction system as more fully disclosed in the aforementioned copending patent applications as discussed earlier in this application. As earlier discussed, the fastener assemblies as discussed more fully in the pending patent applications are received in the female connector units in order to fasten various assemblies and construction elements thereto.

Referring again to FIGS. 3 and 4, it will be understood that the vehicle axle joint 10 which finds usefulness in a toy vehicle 11, or the like, includes a second ball portion which is generally indicated by the numeral 90. The ball portion comprises first and second members 91 and 92, respectively. It should be understood that the first and second members are substantially mirror images of each other, and therefore, like numbers in the drawings will indicate like structures in these two members 91 and 92. As will be appreciated, the first and second members 91 and 92 are joined or otherwise held together and are received within the cavity 60, which is defined by the first socket portion 50, and is moveable relative to that cavity 60 so as to orient the drive shaft 25 in various angular orientations relative to the vehicle frame 14, and the longitudinal X axis 31, such that a hobbyist may rapidly change the design or arrangement of the toy vehicle 11, by, for example, changing the size of the earth engaging wheels 13 so as to create new toy vehicles of assorted designs in a fashion not possible heretofore. In the arrangement as seen in the drawings, each of the first and second members 91 and 92 has a main body 93 which is defined by an outside facing surface 94, and an opposite inside facing surface 95. As seen in the drawings, a plurality of openings 100 are individually defined by the main body 93, when it is completely assembled. More specifically, the plurality of openings 100 include a first opening 101 which will accommodate or otherwise permit the passage of the second end 27, of the drive shaft 25 so that the rotatable drive shaft 25 can forcibly engage the gear assembly 40 which is enclosed within the main body 93. Still further, the main body 93 defines second and third openings 102 and 103, respectively. The second and third openings 102 and 103 are substantially coaxially aligned, and further allow for the passage of the rear axle 24 therethrough so that the rear axles can be mechanically coupled to the gear assembly 40. Still further in an alternative form of the invention as seen in FIG. 4, the main body 93 may further include a fourth opening 104 which may accommodate a second drive shaft 115 such as in the manner of a power take off. This second drive shaft may be utilized to power auxiliary devices which may be carried on the toy vehicle 11. This particular arrangement or feature is useful when the vehicle axle joint 10 is being utilized in a robotic vehicle or assembly which may carry various tools to make the robot more useful. In recent robot competitions, such robots may carry tools for sawing, cutting, grappling or otherwise engaging another robot in order to win a competition regarding the usefulness or robustness of the respective robot design.

The main body 93 is defined by a curved sidewall 105, and a substantially planar sidewall which is generally indicated by the numeral 106. As seen in the drawings, the second and third openings 102 and 103 are defined by the substantially planar sidewall 106. As seen in the drawings, the sidewall 106 has a peripheral edge 110 which defines the respective second and third openings 102 and 103. Yet further, as seen in the drawings, a gear race 111 substantially surrounds the peripheral edge 110 defining the second and third openings 102 and 103, respectively, and is made integral with the sidewall 106. The gear race 111 is defined by a plurality of teeth. When the vehicle axle joint 10 is fully assembled, and as best seen by reference to FIG. 3, the plurality of teeth 74 which extend inwardly relative to the concavely shaped portions 72 and 73, of the third and fourth sidewalls 63 and 64, are operable to meshingly engage the gear race 111. Therefore, when assembled, the main body 93 of the second ball portion 90 can be located or otherwise positioned in predetermined angulated relationships relative to the first socket portion 50 so as to accommodate various toy vehicle 11 designs which have different angles of orientation for the drive shaft 25 relative to the longitudinal or X axis 31, and the vehicle frame 14. This relationship is seen most clearly by a comparison of FIGS. 1 and 2 where that angular orientation is indicated by the symbol Θ. In another form of the invention, the second ball portion 90 may be fabricated without a gear race 111, or teeth 74, thereby permitting the ball portion 90 to be located in any number of a multitude of angular orientations.

Figure 5:
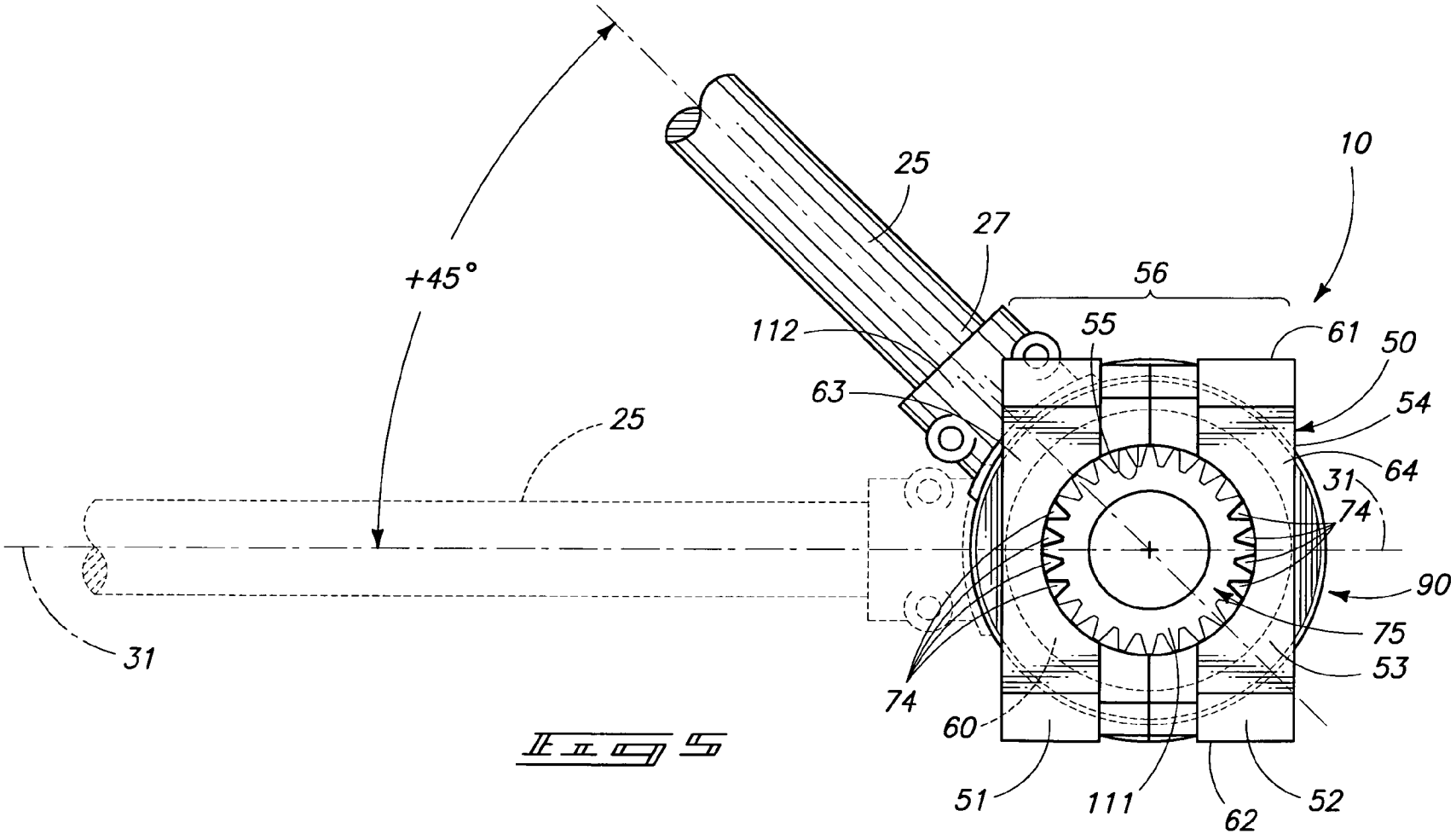
FIG. 5 is a first, fragmentary, side elevation view of a vehicle axle joint for a toy vehicle shown in a first position.
Figure 6:
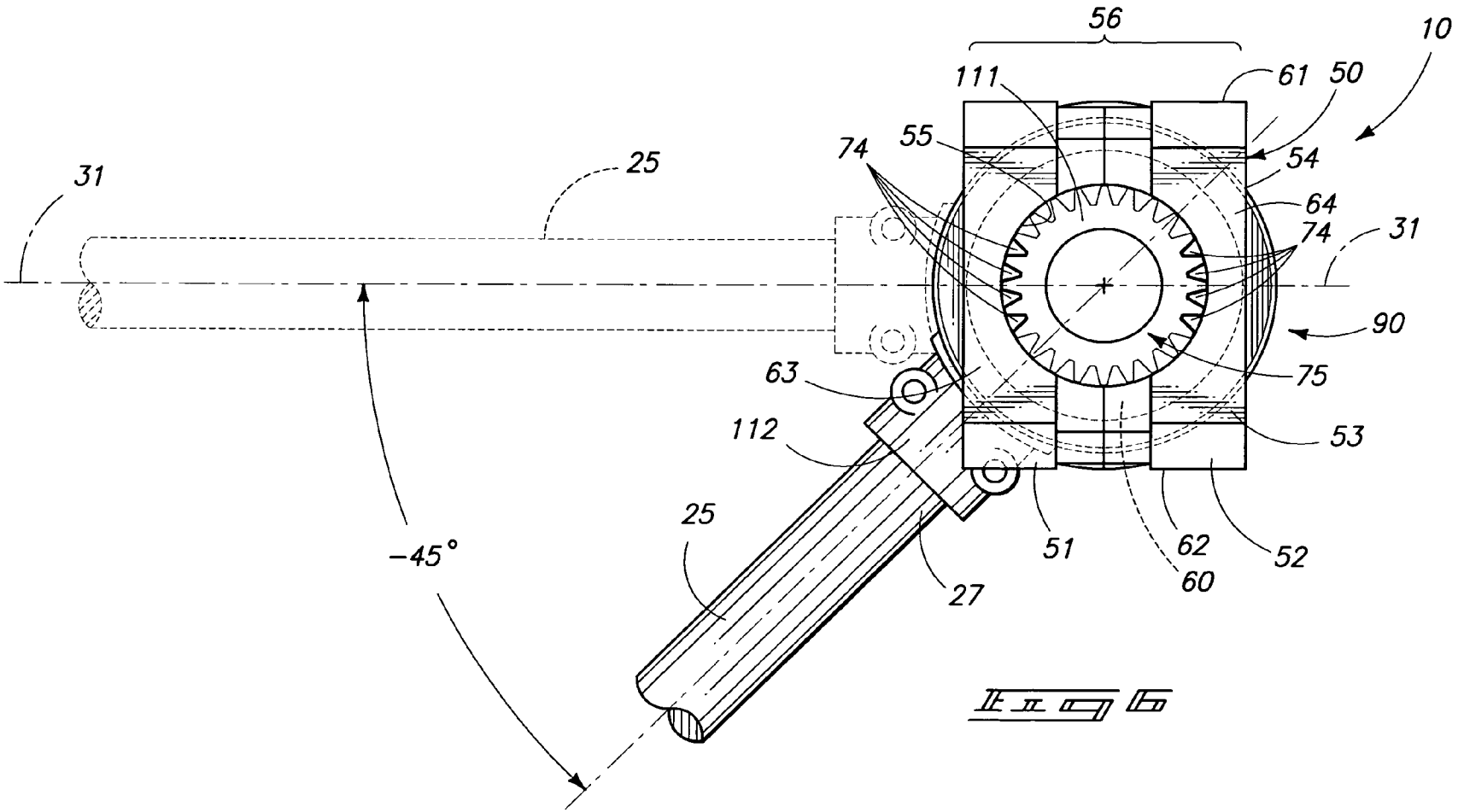
FIG. 6 is a second, fragmentary, side elevation view of a vehicle axle joint for a toy vehicle of the present invention shown in a second position.
Figure 8:
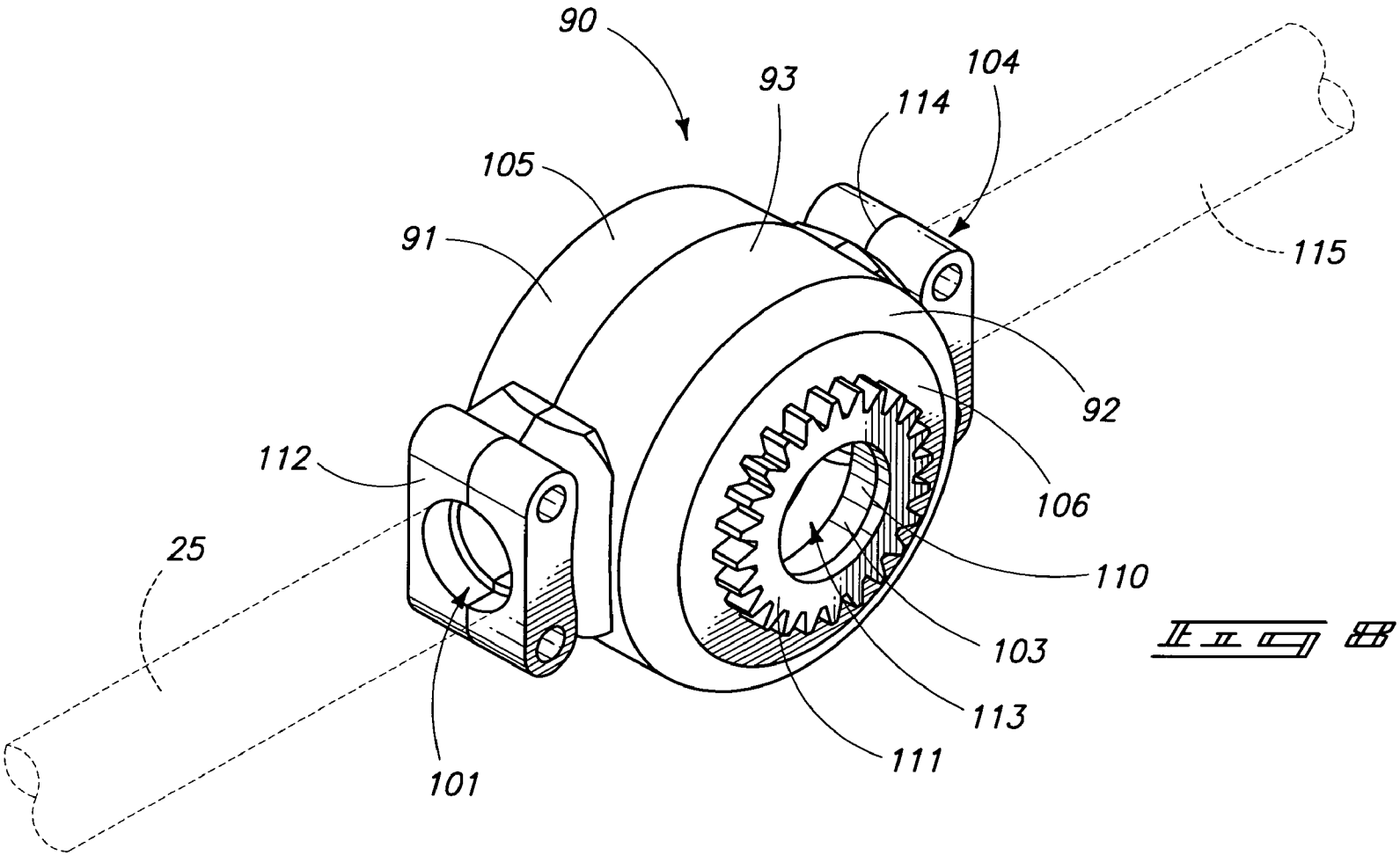
FIG. 8 is a perspective, side elevation view of a second form of the present invention.

More specifically, the arrangement as seen in the drawings, shows a first portion 50 which is substantially rigidly mounted on a frame 14 of a toy vehicle 11, and a second portion 90 which is moveably received within the first portion and which has a X, Y and Z axis 31, 32, and 33, respectively. Further, the second portion 90 defines apertures or openings 102 and 103 for receiving an axle 24 which is borne by the vehicle frame 14 and which is oriented substantially parallel to the Y axis 32, and an aperture or opening 101 for receiving a drive shaft 25 of the toy vehicle 11, and which is oriented substantially along the X axis 31, and wherein the second ball portion 90 is selectively positionable within the first portion 50 so as to allow movement of the aperture or opening 101 for receiving the drive shaft 25 along an arcuately shaped path which is generally oriented along the Z axis 33. This is clearly seen by a study of FIGS. 5 and 6, respectively. In the arrangement as seen in these drawings, the frame 14 of the toy vehicle 11 defines a reference plane relative to the surface of the earth 12, and the second or ball portion 90 positions the drive shaft 25 at a substantially fixed, yet adjustable angle relative to this same reference plane. In the arrangement as seen in the drawings and as discussed above, the drive shaft can be oriented from anywhere between −45 to +45 degrees as measured relative to the rear axle 24 or the X axis 31. In the arrangement as seen in the drawings, the main body 93 includes a neck or channel portion 112 which extends outwardly relative to the main body and which receives the second end 27 of the drive shaft 25. Still further, the inside facing surface 95 of the main body 93 defines a gear cavity 113 which is sized so as to matingly receive and appropriately support the gear assembly 40 which is seen in the exploded view as seen in FIG. 7. As illustrated in the drawings (FIG. 8) in one form of the invention, the second portion 90 may include a second neck or channel member 114. The second neck or channel portion may accommodate or otherwise receive a second drive shaft 115, as earlier discussed, and which may power additional assemblies on the toy vehicle 11.

Operation

The operation of the described embodiment of the present invention is believed to be readily apparent and is briefly summarized at this point.

In its broadest aspect, the present invention relates to a vehicle axle joint 10 for a toy vehicle 11 and which includes a first socket portion 50; and a second ball portion 90 which matingly cooperates with the socket portion 50, and which defines a gear cavity 113 and wherein the second ball portion 90 further defines at least two openings 101 and 102 and which are individually configured to receive at least one drive shaft 25 and another shaft, such as a rear axle 24 and which is configured to receive power from the one drive shaft 25. In the arrangement as seen in the drawings, the socket portion 50 defines passageways or openings 65, 75 and 76, respectively through which the shafts, mentioned above, extend. In addition to the foregoing, the ball portion 90 defines, as earlier discussed, three openings 101, 102 and 103, respectively. In this arrangement, at least two of the openings 102 and 103 oppose or are coaxially aligned with each other and are configured to receive an axle 24 of the toy vehicle. In the arrangement as disclosed above, the ball portion 90 may comprise, in one form of the invention (FIG. 8), a fourth opening 104 which is configured to receive a second drive shaft 115. In the present invention 10, the ball portion 90 has an outer or outside facing surface 94, and the socket portion 50 defines an inwardly facing surface 55, and corresponding cavity 60, and which is configured to matingly engage and otherwise enclose, at least in part, the outer surface 94 of the second ball portion 90. In the arrangement as seen in the drawings, the outer surface 94 of the ball portion 90 includes a perimeter portion or peripheral edge 110 which substantially surrounds or otherwise defines the respective openings 102 or 103. Further, the inner surface 55 of the socket portion 50 engages the perimeter thereof in order to prohibit rotation of the ball portion 90 within the socket portion 50. In the arrangement as seen in the drawings, the ball and socket portions 50 and 90, respectively, each comprise at least two mirror image components 51 and 52; and 91 and 92, respectively, and which matingly cooperate together to form each of these components.

In the arrangement as seen in the drawings, the vehicle axle joint 10 for a toy vehicle 11 is operable to provide rotational force from at least one rotating drive shaft 25 to an axle 24 of a toy vehicle 1. In this arrangement, the vehicle axle joint 10 includes an outer portion 50 which defines an internal cavity 60 and wherein the outer portion 50 has at least one female connector unit 80 which matingly cooperates with at least one connector unit of a construction system; and an inner portion 90 which is received within the cavity 60 defined by the outer portion 50, and wherein the outer portion 50 engages the inner portion so as to selectively orient the inner portion 90 relative to the outer portion 50. In this arrangement, the outer portion 50 comprises at least two components or members 51 and 52, respectively, and which are configured to couple or otherwise matingly cooperate with each other, and wherein the components 51 and 52 are made integral with the connector units 80. As earlier discussed, the plurality of female connector units 80 are operable to cooperate with a construction system as described in the copending applications which are incorporated by reference herein.

More specifically, the vehicle axle joint 10 for a toy vehicle 11 includes a vehicle frame 14 which has a length dimension as measured along a longitudinal or X axis 31, and a width dimension as measured along a transverse or Y axis 32. The arrangement as shown in the drawings includes a motor 20 mounted on the vehicle frame 14, and a drive shaft 25 having a first end 26 which is mechanically coupled to the motor 20 and a second end 27. The drive shaft is oriented substantially along or is in the plane of the longitudinal or X axis 31 of the vehicle frame 14. The arrangement as shown in the drawings includes a gear assembly 40 which is mechanically coupled to the second end 27 of the drive shaft 25. An axle 24 is borne by the vehicle frame 14 and is mechanically coupled to the gear assembly 40. The axle 24 is located in substantially parallel relation relative to the transverse or Y axis 32 of the vehicle frame 14. An adjustable ball portion 90 defining a gear cavity 113 encloses the gear assembly 40. A socket portion 50 defining a housing 56 is releasably mounted on the vehicle frame 14 and defines a cavity 60 for receiving, supporting and allowing the movement of the adjustable ball portion 90. The adjustable ball portion 90 can be selectively positioned within the cavity 60 of the housing so as to accommodate a range of angular relationships as measured between the drive shaft 25 and the longitudinal or X axis 31 of the toy vehicle 11 (see FIGS. 1 and 2). In the arrangement as seen in the drawings (FIGS. 5 and 6), the angular relationship between the drive shaft 25, and the longitudinal or X axis 31 of the toy vehicle 11 may range from about −45 degrees to about +45 degrees relative to the longitudinal or X axis 31 of the toy vehicle 11. Additionally, it should be understood that the adjustable ball portion 90 can be either selectively fixably positioned in a plurality of positions within the cavity 60 of the housing 56 as occasioned by the selective positioning of the gear race 111 relative to the plurality of teeth 74 which engage same or with the removal of the gear race 111, or the teeth 74. The ball portion may also be rendered continuously moveable within the aforementioned angular range by the removal of either the gear race 111 or the teeth 74.

In the arrangement as seen in the drawings, the toy vehicle 11 is frequently remotely controlled by the hobbyist. Further, and as earlier discussed, the housing 56 comprises two members 51 and 52, which are substantially mirror images of each other, and which define the cavity 60 therebetween which is sized to receive and cooperate with the adjustable ball portion 90. As seen in FIG. 3, a portion of the ball portion extends out of the cavity 60 through the openings 65 has defined by each member 51 and 52 respectively. In the arrangement as seen in the drawings, the adjustable ball portion 90 defines a first opening 101 which is dimensioned to receive the second end 27 of the drive shaft 25, and second and third openings 102 and 103, respectively, which are substantially coaxially aligned and which receive the axle 24 therethrough. The adjustable ball portion 90 has an outside facing surface 94 defining a peripheral edge 110. The peripheral edge 110 further defines the second and third openings 102 and 103, respectively. Still further, a plurality of gear teeth 111 (in one form of the invention) substantially surrounds the second and third openings 102 and 103, respectively. As earlier discussed, the socket portion 50 defines a pair of openings 75 and 76 which are substantially coaxially aligned and which are concentrically oriented relative to the second and third openings 102 and 103 defined by the adjustable ball portion 90 when the ball portion 90 is received within the cavity 60 defined by the first socket portion 50. As earlier discussed, the socket portion 50 defines at least one tooth 74 which is sized so as to be meshingly received between the plurality of gear teeth 111 which surround the second and third openings 102 and 103 of the ball portion 90 so as to prohibit movement of the adjustable ball portion 90 within the cavity 60 as defined by the socket portion 50.

Therefore, a vehicle axle joint 10 for a toy vehicle 11 is described herein and which includes a first portion 50 which is substantially rigidly mounted on a frame 14 of a toy vehicle 11; and a second portion 90 moveably received within the first portion 50. As described herein, the toy vehicle 11 has an X, Y, and Z axis 31, 32, and 33, respectively. Still further, the second portion defines apertures 102 and 103 for receiving an axle 24 borne by the frame 14 of the toy vehicle 11 along the Y axis 32, and an aperture 101 for receiving a drive shaft 25 of the toy vehicle 11 along the X axis 31. The second portion 90 is selectively positionable within the first portion 50 so as to position the aperture or opening 101 for receiving the drive shaft 25 along an arcuately shaped path of travel which is oriented along the Z axis 33. In the arrangement as seen in the drawings, the axle 24 is drivingly coupled to at least one wheel 13 which engages an underlying supporting surface, such as the surface of the earth 12. In an alternative arrangement, the axle may be coupled to at least one rotating or reciprocating member which forcibly engages the underlying supporting surface 12. This may include, for example, a track, or other earth engaging element. A suitable track arrangement is seen in copending application Ser. No. 11/724,422, the teachings of which are incorporated by reference herein.

Therefore, it will be understood that the present invention provides a very convenient means by which a hobbyist may readily locate and otherwise position, a vehicle axle joint 10 for a toy vehicle 11 in a plurality of advantageous locations relative to a vehicle frame 14 so as to accommodate earth engaging wheels of various diameters and designs. Further, this invention permits a hobbyist to build toy vehicles 11 of various designs in a manner not possible heretofore. Additionally, the present invention can be used in combination with the construction systems described in the aforementioned copending patent applications which are now on file in the Patent Office and which have been filed by the inventors of record.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A toy vehicle with an axle, comprising:

a vehicle frame having a longitudinal and transverse axis;

a motor mounted on the vehicle frame;

a drive shaft oriented along the longitudinal axis of the vehicle frame, and which has a first end which is mechanically coupled to the motor and an opposite second end;

a gear assembly mechanically coupled to the second end of the drive shaft, and wherein the gear assembly is moveably adjustable only in a vertical plane relative to the vehicle frame;

an axle mounted on the vehicle frame and which is mechanically coupled to the gear assembly, and wherein the axle is located substantially parallel to the transverse axis of the vehicle frame and is not moveable in a horizontal plane relative to the vehicle frame;

an adjustable ball portion defining a gear cavity that encloses the gear assembly and further receives and cooperates with both the second end of the drive shaft, and the axle, and wherein the adjustable ball portion is adjustably moveable only in the vertical plane relative to the vehicle frame, and wherein the adjustable ball portion is immovable relative to the vehicle frame during the operation of the toy vehicle, and wherein the adjustable ball portion has an outside facing surface defining a peripheral edge, and wherein a plurality of gear teeth are defined by the peripheral edge; and a socket portion defining a housing which is releasably mounted on the vehicle frame but which is immovable in either the vertical or horizontal planes relative to the vehicle frame during the operation of the toy vehicle, and wherein the housing of the socket portion comprises two mirror image members which when brought together and assembled on the vehicle frame define a cavity therebetween which is sized so as to receive, and immovably orient the adjustable ball portion in a given position relative to the vehicle frame, and wherein the mirror image members of the housing must be separated from each other so as to permit the adjustable movement of the adjustable ball portion in the vertical plane relative to the vehicle frame, and wherein at least one of the mirror image members of the socket portion has a tooth which meshingly engages the plurality of gear teeth as defined by the adjustable ball portion so as to prohibit the vertical movement of the adjustable ball portion relative to the vehicle frame when the toy vehicle is in operation.

* * * * *